US008515315B2

(12) United States Patent
Kawano et al.

(10) Patent No.: US 8,515,315 B2
(45) Date of Patent: Aug. 20, 2013

(54) DEVELOPING DEVICE AND IMAGE FORMING APPARATUS

(75) Inventors: Masahiro Kawano, Tokyo (JP); Shinichi Otani, Tokyo (JP)

(73) Assignee: Oki Data Corporation, Tokyo (JP)

( * ) Notice: Subject to any disclaimer, the term of this patent is extended or adjusted under 35 U.S.C. 154(b) by 266 days.

(21) Appl. No.: 13/019,495

(22) Filed: Feb. 2, 2011

(65) Prior Publication Data

US 2011/0217084 A1 Sep. 8, 2011

(30) Foreign Application Priority Data

Mar. 5, 2010 (JP) ..... 2010-049290

(51) Int. Cl.
*G03G 15/08* (2006.01)

(52) U.S. Cl.
USPC ..... 399/254; 399/281

(58) Field of Classification Search
USPC ..... 399/254, 258, 281
See application file for complete search history.

(56) References Cited

U.S. PATENT DOCUMENTS

2005/0123324 A1 6/2005 Kawano et al.

FOREIGN PATENT DOCUMENTS

| | | | |
|---|---|---|---|
| EP | 1 538 489 | | 6/2005 |
| JP | 01108580 A | * | 4/1989 |
| JP | 2002372853 A | * | 12/2002 |
| JP | A-2005-172842 | | 6/2005 |
| JP | 2008164951 A | * | 7/2008 |

* cited by examiner

*Primary Examiner* — David Gray
*Assistant Examiner* — Erika J Villaluna
(74) *Attorney, Agent, or Firm* — Posz Law Group, PLC

(57) ABSTRACT

A developing device includes a developer bearing body, a first developer supply member, a second developer supply member, and a compression member. The developer bearing body bears a developer. The first developer supply member supplies the developer to the developer bearing body. The second developer supply member moves the developer in the vicinity of the first developer supply member to the first developer supply member. The compression member opposes, and is out of contact with, the first developer supply member. The compression member also directs the developer moved by the second developer supply member to the first developer supply member, and compresses the developer between the first developer supply member and the compression member.

20 Claims, 12 Drawing Sheets

FIG. 9

| NUMBER OF PRINTS | RESULTS | | |
|---|---|---|---|
| | FIRST EMBODIMENT | FIRST COMPARATIVE EXAMPLE | SECOND COMPARATIVE EXAMPLE |
| 0 | ○ | ○ | ○ |
| 2000 | ○ | ○ | △ |
| 4000 | ○ | △ | △ |
| 6500 | ○ | △ | △ |
| 7500 | ○ | × | × |

DEVELOPING DEVICE AND IMAGE FORMING APPARATUS

CROSS-REFERENCE TO RELATED APPLICATION

This application claims priority based on 35 U.S.C. §119 from prior Japanese Patent Application No. P 2010-049290, filed on Mar. 5, 2010, the entire contents of which are incorporated herein by reference.

BACKGROUND

This application relates to a developing device that develops an electrostatic latent image formed on an image bearing body. This application also relates to an image forming apparatus that includes the developing device.

A developing device includes a developing roller, a toner supply roller, and an agitator. The developing roller, which serves as a developer bearing body, develops an electrostatic latent image on a photosensitive drum, which serves as an image bearing body, with toner, or a developer. The toner supply roller, which serves as a developer supply member, supplies the toner to the developing roller. The agitator, which serves as a developer agitation member, agitates the toner so that the toner is efficiently moved to the toner supply roller. Japanese Laid-Open Patent No. 2005-172842 discloses one such developing device.

In such a developing device, however, toner may not be stably supplied to the developing roller as the amount of toner decreases, resulting in the occurrence of image defects such as image blurring.

SUMMARY

An object of this application is to disclose a developing device and an image forming apparatus that are capable of providing a steady supply of a developer to a developer bearing body.

According to one aspect, a developing device includes a developer bearing body, a first developer supply member, a second developer supply member, and a compression member. The developer bearing body bears a developer. The first developer supply member supplies the developer to the developer bearing body. The second developer supply member moves the developer in the vicinity of the first developer supply member to the first developer supply member. The compression member opposes, and is out of contact with, the first developer supply member. The compression member also directs the developer moved by the second developer supply member to the first developer supply member, and compresses the developer between the first developer supply member and the compression member.

According to another aspect, an image forming unit includes a developing unit, a transfer unit, and a fixing unit. The developing unit develops an electrostatic latent image on an image bearing body with a developer to form a developed image, and includes a developer bearing body, a first developer supply member, a second developer supply member, and a compression member. The developer bearing body bears the developer. The first developer supply member supplies the developer to the developer bearing body. The second developer supply member moves the developer in the vicinity of the first developer supply member to the first developer supply member. The compression member opposes, and is out of contact with, the first developer supply member. The compression member also directs the developer moved by the second developer supply member to the first developer supply member, and compresses the developer between the first developer supply member and the compression member. The transfer unit transfers the developed image to a medium. The fixing unit fixes the developed image onto the medium.

The full scope of applicability of the developing device and the image forming apparatus will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The developing device and the image forming apparatus will be more fully understood from the following detailed description with reference to the accompanying drawings, which are given by way of illustration only, and should not limit the invention, wherein:

FIG. 9 is a table showing results of an evaluation test for the first embodiment, the first comparative example, and the second comparative example;

DETAILED DESCRIPTION

Preferred embodiments of a developing device and an image forming apparatus according to various embodiments will be described in detail with reference to the accompanying drawings. In each embodiment, the description will be given with reference to an electrophotographic color printer as an image forming apparatus.

First Embodiment

Figure 1:
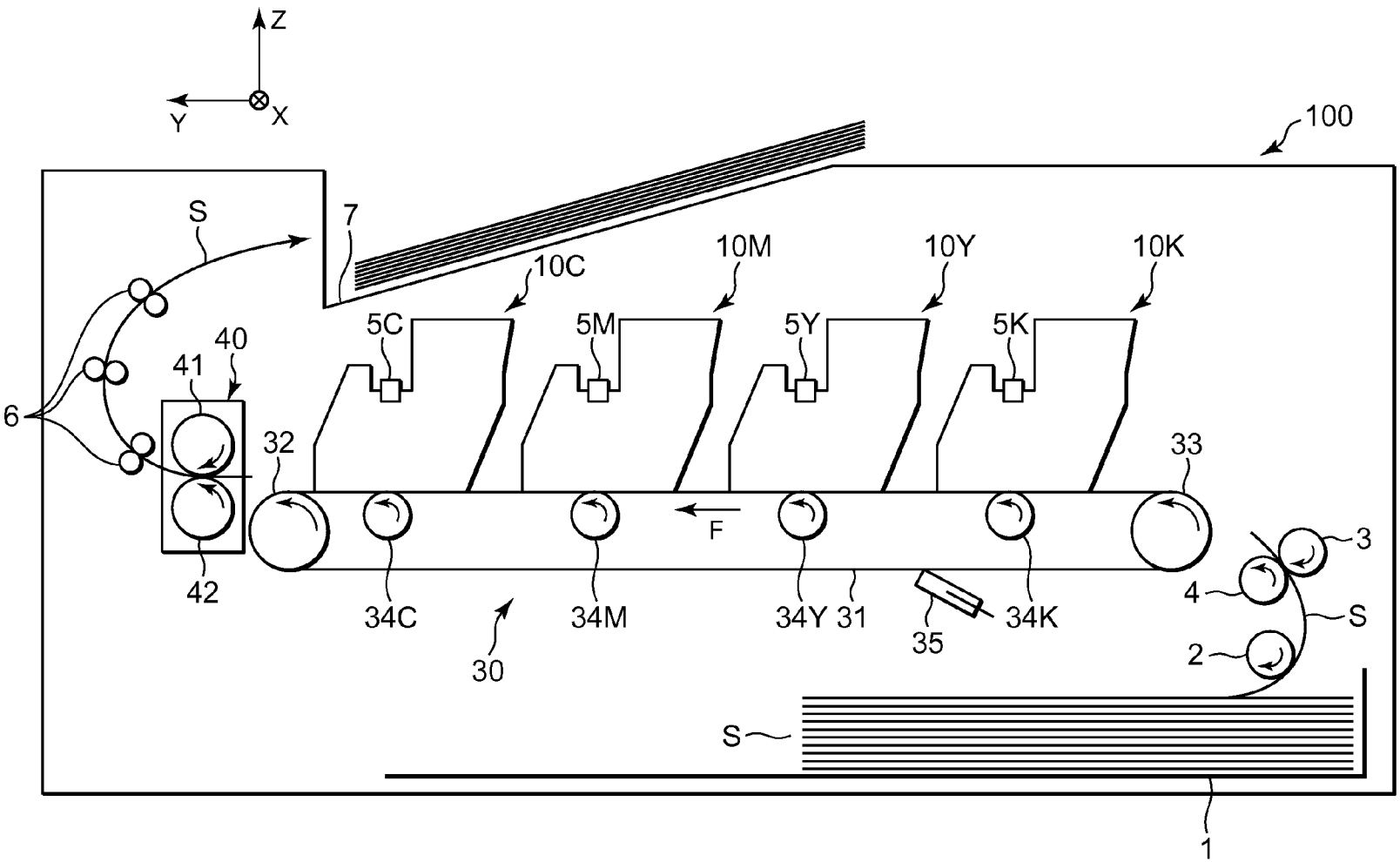
FIG. 1 is a schematic view of a printer of a first embodiment.

FIG. 1 is a schematic view of a printer 100 of a first embodiment, which may include a sheet cassette 1, a pick-up roller 2, a registration roller 3, a pinch roller 4, image-forming units 10K, 10Y, 10M, and 10C, exposure heads 5K, 5Y, 5M, and 5C, a transfer unit 30, a fixing unit 40, transport rollers 6 and a stacker 7.

The sheet cassette 1 is disposed in the lower part of the printer 100, and accommodates a stack of sheets S. The pick-up roller 2 feeds the sheets S one-by-one from the sheet cassette 1. The registration roller 3 and the pinch roller 4 sandwich a sheet S fed by the pick-up roller 2 therebetween, and transport the sheet S toward the image-forming units 10K, 10Y, 10M, and 10C. The registration roller 3 and the pinch roller 4 also correct skewed feeding of the sheet S.

The image-forming units 10K, 10Y, 10M, and 10C, which serve as developing devices, respectively form a black toner image, a yellow toner image, a magenta toner image, and a cyan toner image. The image-forming units 10K, 10Y, 10M, and 10C are arranged in this order from upstream to downstream in the transport direction F of the sheet S. The exposure heads 5K, 5Y, 5M, and 5C are respectively provided corresponding to the image-forming units 10K, 10Y, 10M, and 10C. Each of the exposure heads 5K, 5Y, 5M, and 5C may be an LED (Light-Emitting Diode) head.

The transfer unit 30, which is disposed below the image-forming units 10K, 10Y, 10M, and 10C, may include a transfer belt 31, a drive roller 32, a tension roller 33, transfer rollers 34K, 34Y, 34M, and 34C, and a belt cleaning blade 35. The transfer belt 31 is entrained about the drive roller 32 and the tension roller 33, and transports the sheet S in the transport direction F while electrostatically adhering it. The transfer rollers 34K, 34Y, 34M, and 34C respectively oppose the image-forming units 10K, 10Y, 10M, and 10C through the transfer belt 31. The transfer roller 34K transfers the black toner image formed by the image-forming unit 10K to the sheet S. The transfer roller 34Y transfers the yellow toner image formed by the image-forming unit 10Y to the sheet S. The transfer roller 34M transfers the magenta toner image formed by the image-forming unit 10M to the sheet S. The transfer roller 34C transfers the cyan toner image formed by the image-forming unit 10C to the sheet S. The belt cleaning blade 35 removes toner on the transfer belt 31.

The fixing unit 40, which is disposed downstream of the image-forming units 10K, 10Y, 10M, and 10C in the transport direction F, may include a heat roller 41 and a backup roller 42. The fixing unit 40 fixes the transferred toner images onto the sheet S with heat and pressure. The transport rollers 6, which are disposed downstream of the fixing unit 40, deliver the sheet S with the fixed toner images thereon to the stacker 7. The stacker 7 holds the sheet S delivered by the transport rollers 6 thereon.

In FIG. 1, an X-axis, a Y-axis, and a Z-axis respectively denote a direction parallel to a rotational axis of a photosensitive drum 11 described later, a direction parallel to the transport direction F of the sheet S on the transfer belt 31, and a direction perpendicular to both of these directions. It should be noted that the X-axes, the Y-axes, and the Z-axes in other drawings respectively denote the same directions as the X-axis, the Y-axis, and the Z-axis in FIG. 1.

Next, the image-forming units 10K, 10Y, 10M, and 10C will be described in detail. Because the image-forming units 10K, 10Y, 10M, and 10C have the same structure, except for toner colors, the image-forming unit 10K, which forms a black toner image, will be described by way of example here.

Figure 2:
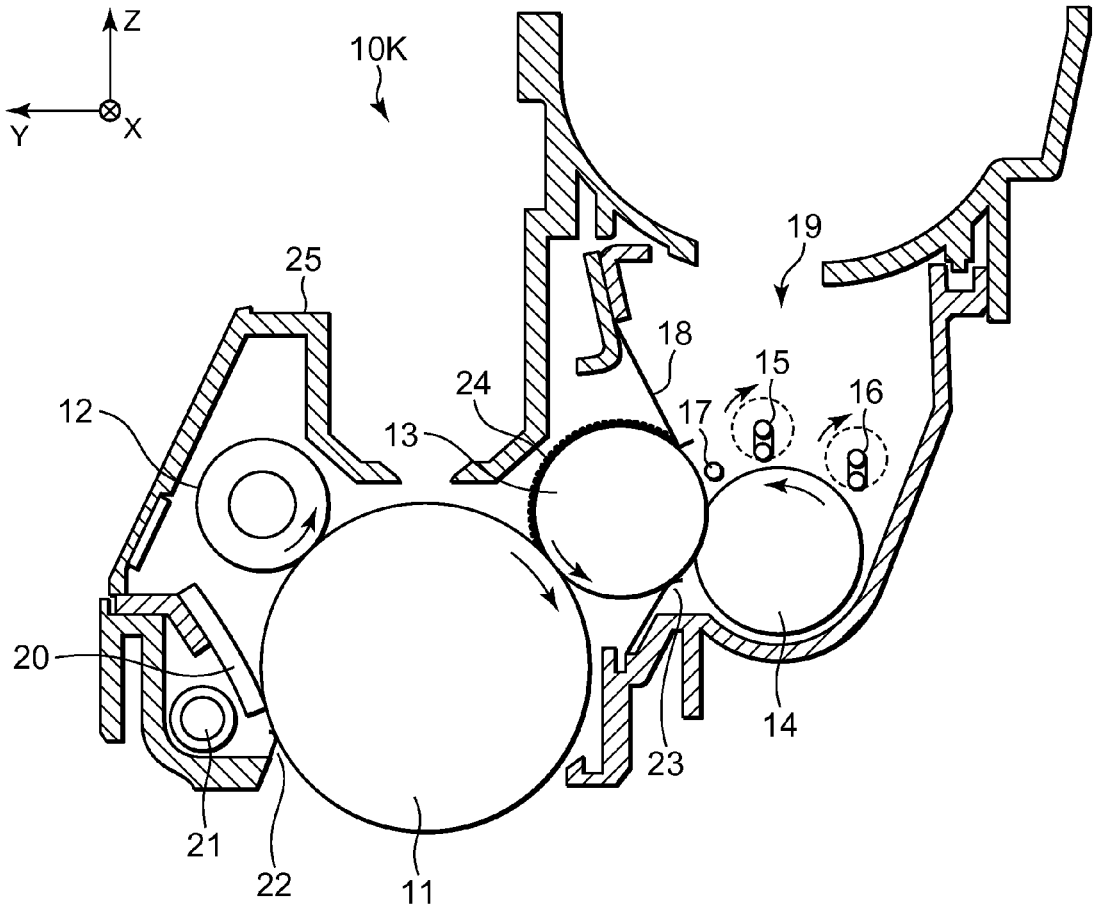
FIG. 2 is a schematic view of an image-forming unit of the first embodiment.

FIG. 2 is a schematic view of the image-forming unit 10K, which may include the photosensitive drum 11, a charging roller 12, a developing roller 13, a toner supply roller 14, agitators 15 and 16, a compression member 17, a developing blade 18, a toner storage portion 19, a cleaning blade 20, a spiral conveyer 21, and sealing members 22 and 23.

The photosensitive drum 11, which serves as an image bearing body, bears an electrostatic latent image formed by the exposure head 5K on its surface. The photosensitive drum 11 may be composed of an aluminum cylinder coated with an organic photosensitive layer. The photosensitive drum 11 rotates in the direction shown in FIG. 2 with a driving force from a driving source through a gear attached to one end of its rotational axis.

The charging roller 12, which serves as a charging member, rotates while being in contact with the surface of photosensitive drum 11 to uniformly charge the surface. The charging roller 12 may be composed of a metallic shaft coated with semi-conductive epichlorohydrin rubber. In the first embodiment, this shaft has a major diameter of 6 mm, and the charging roller 12 including the epichlorohydrin rubber has a major diameter of 12 mm.

The developing roller 13, which serves as a developer bearing body, develops the electrostatic latent image on the photosensitive drum 11 with toner 24, or a developer. The developing roller 13 may be composed of a metallic shaft coated with semi-conductive urethane rubber. In the first embodiment, this shaft has a major diameter of 10 mm, and the developing roller 13 including the urethane rubber has a major diameter of 16 mm. The developing roller 13 is disposed so that the photosensitive drum 11 bites 0.1 mm into the developing roller 13. That is to say, the distance between centers of a rotational axis of the photosensitive drum 11 and a rotational axis of the developing roller 13 is 0.1 mm less than the sum of their radii. The developing roller 13 rotates in the direction shown in FIG. 2 with a driving force from a driving source through a gear attached to one end of its rotational axis.

The toner supply roller 14, which serves as a first developer supply member, supplies the toner 24 to the developing roller 13. The toner supply roller 14 may be composed of a metallic shaft coated with semi-conductive foamed silicone rubber. In the first embodiment, this shaft has a major diameter of 6 mm, and the toner supply roller 14 including the silicone rubber has a major diameter of 15.5 mm. The toner supply roller 14 is disposed so that the developing roller 13 bites 1 mm into the toner supply roller 14. That is to say, the distance between centers of a rotational axis of the developing roller 13 and a rotational axis of the toner supply roller 14 is 1 mm less than the sum of their radii.

The agitators 15 and 16, which serve as second developer supply members, are disposed above and in the vicinity of the toner supply roller 14. The agitators 15 and 16 agitate the toner 24 in the toner storage portion 19.

Figure 3:
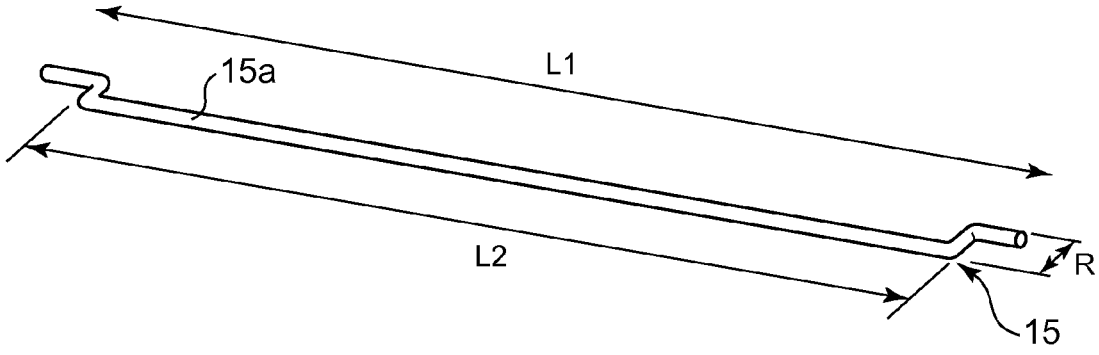
FIG. 3 is a perspective view of an agitator of the first embodiment.

FIG. 3 is a perspective view of the agitator 15. As shown in FIG. 3, the agitator 15, which is a metallic crank bar, has a major diameter of 1.5 mm and an entire length L1 of 240 mm. A crank portion 15*a* of the agitator 15 has a length L2 of 220 mm and a radius of rotation R of 2.75 mm. The agitator 15 rotates in the direction shown in FIG. 2 with a driving force from a driving source through a gear attached to its one end. The agitator 16 is similar in structure to the agitator 15.

Returning to FIG. 2, the first embodiment, the agitators 15 and 16, which are identical and rotate in the same direction, are arranged side-by-side in the rotational direction of the toner supply roller 14, as shown in FIG. 2. Each of the agitators 15 and 16 is disposed so that a nearest distance between the crank portion 15*a* and the toner supply roller 14 is 0.4 mm.

The compression member 17 lies downstream of the agitator 15 in the rotational direction of the toner supply roller 14. That is to say, the compression member 17 is disposed between the agitator 15 and the developing roller 13. The compression member 17 directs toner 24 sent forth by the agitator 15 to the toner supply roller 14, and compresses the toner 24 between the toner supply roller 14 and the compression member 17, thereby making the toner 24 dense.

Figure 4:
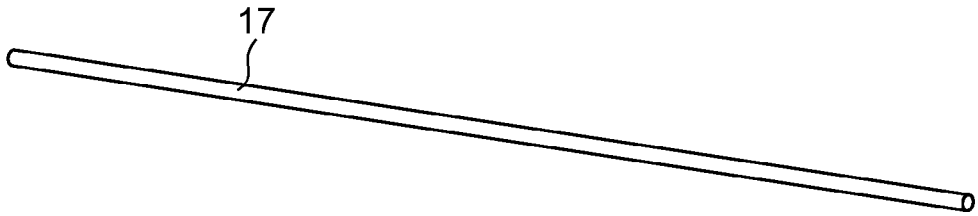
FIG. 4 is a perspective view of a compression member of the first embodiment.

FIG. 4 is a perspective view of the compression member 17. As shown in FIG. 4, the compression member 17 is a round bar made of metal such as stainless steel, and has a major diameter of 2 mm. The compression member 17 is disposed so that the distance between surfaces of the toner supply roller 14 and the compression member 17 is 1 mm.

Multiple compression members 17 may be provided in the image-forming unit 10K. For instance, in FIG. 2, another compression member 17 may be disposed in the vicinity of the agitator 16, which lies upstream of the agitator 15 in the rotational direction of the toner supply roller 14. The compression member 17 may have a star-shaped cross-section or a notched circular cross-section. In addition, the compression member 17 may be plate-like. Moreover, the compression member 17 may have different cross-sectional areas in its central portion and in each end portion in its longitudinal direction. Furthermore, the compression member 17 may be made of synthetic resin or rubber.

The developing blade 18, which serves as a layer thickness adjusting member, adjusts a thickness of a layer of toner 24 on the developing roller 13 to a predetermined thickness. The developing blade 18 is made of stainless steel and has a thickness of 0.08 mm. The developing blade 18 has a bent portion at one end. The bent portion has a predetermined radius of curvature, and is pressed toward the developing roller 13.

The toner storage portion 19, which serves as a developer storage portion, stores the toner 24 supplied from a toner cartridge mounted over the toner storage portion 19. The toner storage portion 19 incorporates the developing roller 13, the toner supply roller 14, the agitators 15 and 16, the compression member 17, and the developing blade 18 therein.

The cleaning blade 20, which serves as a cleaning member, scrapes toner that remains on the photosensitive drum 11 after the toner image has been transferred to the sheet S or the transfer belt 31, off the photosensitive drum 11. The cleaning blade 20 may be composed of a metallic plate to which urethane rubber formed to predetermined dimensions has been attached.

The spiral conveyer 21, which is made of metal, is disposed under the cleaning blade 20. The spiral conveyer 21 rotates with a driving force from a driving source through a gear attached to its one end, and conveys the scraped off toner, i.e., waste toner, to a waste toner chamber, not shown.

The sealing member 22, which has a film shape, is provided in the vicinity of the spiral conveyer 21 to prevent the waste toner conveyed by the spiral conveyer 21 from leaking out of the image-forming unit 10K. The sealing member 23, which has a film shape, is provided under the developing roller 13 to prevent the toner 24 in the toner storage portion 19 from leaking out of the image-forming unit 10K.

The toner 24 is nonmagnetic one-component toner, and has an average particle size of 5.5 μm. The toner 24 may be made by a grinding technique. The toner 24 contains fine particles of silica or oxidized titanium, which serve as additives, for controlling toner flowability and chargeability. Each of the particles has a particle size on the order of a few nanometers. In the first embodiment, the toner 24 is negatively chargeable, i.e., a polarity of the toner 24 is to be negative when it is triboelectrically charged.

The image-forming unit 10K also has a molded cover 25. The cover 25 protects the above-described elements of the image-forming unit 10K, and prevents the toner 24 from leaking out of the image-forming unit 10K.

Figure 5:
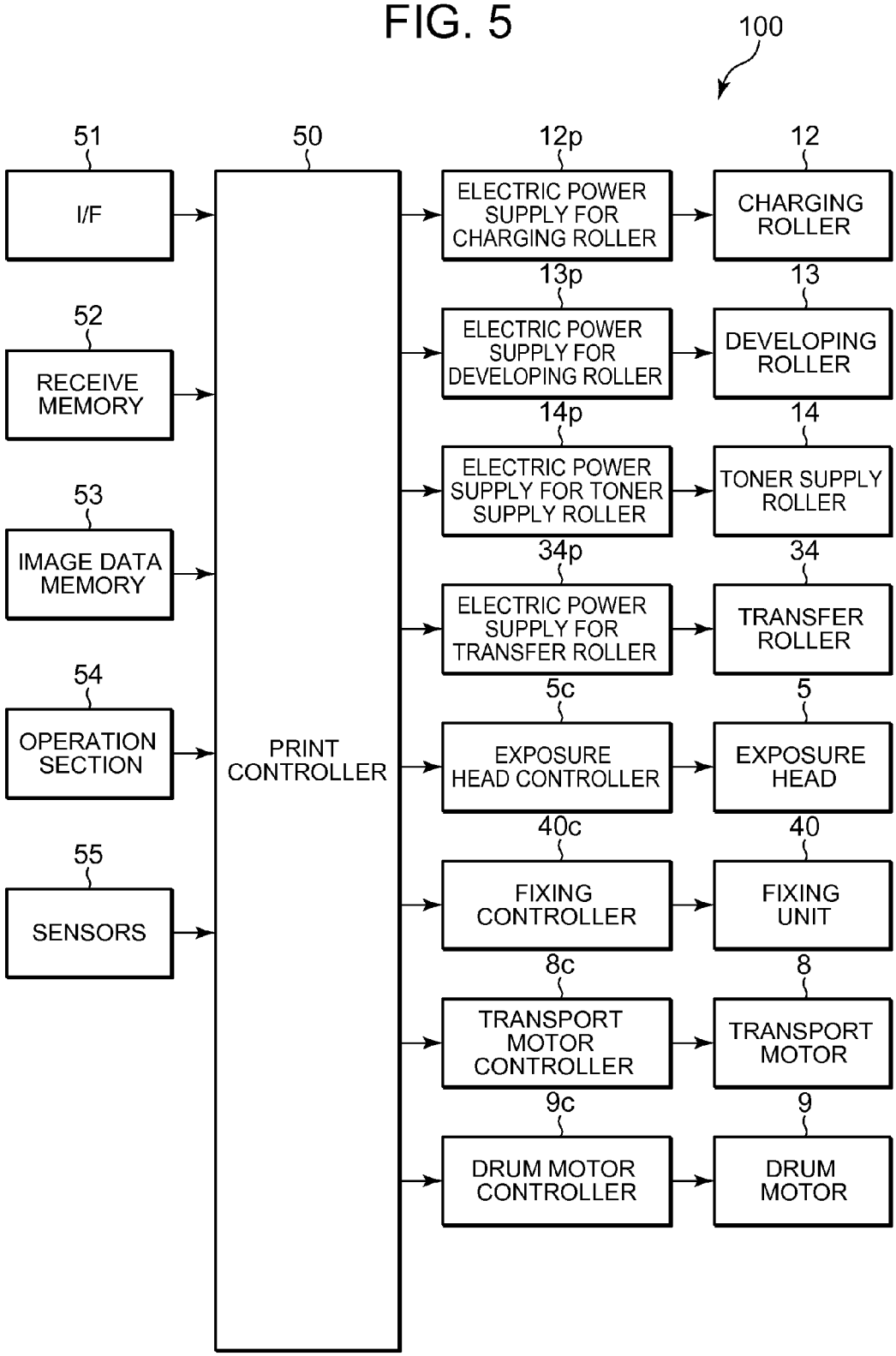
FIG. 5 is a block diagram of the printer of the first embodiment.

Next, a control system of the printer 100 will be described. FIG. 5 is a block diagram of the printer 100. The printer 100 may include a print controller 50, an interface (I/F) 51, a receive memory 52, an image data memory 53, an operation section 54, and sensors 55. The printer 100 may also include an electric power supply 12*p* for the charging roller 12, an electric power supply 13*p* for the developing roller 13, an electric power supply 14*p* for the toner supply roller 14, and an electric power supply 34*p* for the transfer roller 34. The printer 100 further may include an exposure head controller 5*c*, a fixing controller 40*c*, a transport motor controller 8*c*, and a drum motor controller 9*c*.

The print controller 50 may be composed of a microprocessor, memories such as a ROM (Read Only Memory) and a RAM (Random Access Memory), an input/output (I/O) port, and a timer. The print controller 50 receives print data and control commands from a host device such as a personal computer, not shown, through the interface 51, and controls the entire printer 100 according to control programs stored in the memories, thereby performing a printing operation. The receive memory 52 temporarily stores the print data received through the interface 51. The image data memory 53 sequentially stores the print data temporarily stored in the receive memory 52. The image data memory 53 also stores image data generated by the print controller 50 based on the print data. The operation section 54 may include an LED, a switch, and a display. The LED notifies a user of the status of the printer 100. The user can provide instructions to the printer 100 through the switch and the display. The sensors 55 are various sensors, such a medium sensor, a hygrothermal sensor, and a print density sensor, to monitor the status of the printer 100.

The electric power supplies 12*p*, 13*p*, 14*p*, and 34*p* respectively apply predetermined voltages to the charging roller 12, the developing roller 13, the toner supply roller 14, and the transfer roller 34, according to commands from the print controller 50.

The exposure head controller 5*c* sends the image data stored in the image data memory 53 to the exposure head 5, and drives the exposure head 5 based on the image data, according to commands from the print controller 50. The fixing controller 40*c* applies a voltage to the fixing unit 40, and causes the fixing unit 40 to fix a toner image transferred to the sheet S onto the sheet S, according to commands from the print controller 50. The transport motor controller 8*c* controls a transport motor 8, which rotates the pick-up roller 2, the drive roller 32, and the like, to transport the sheet S. That is to say, the transport motor controller 8*c* initiates and stops the transportation of the sheet S with predetermined timing according to commands from the print controller 50. The drum motor controller 9*c* controls a drum motor 9 to rotate the photosensitive drum 11. When the drum motor controller 9*c* drives the drum motor 9, the photosensitive drum 11 rotates in the direction shown in FIG. 2. In conjunction with the rotation of the photosensitive drum 11, the charging roller 12, the developing roller 13, the toner supply roller 14, and the agitators 15 and 16 respectively rotate in the directions shown in FIG. 2.

Next, a printing operation of the printer 100 will be described with reference to FIG. 1. When the printing operation is initiated, the pick-up roller 2 feeds the sheets S one-by-one from the sheet cassette 1 into a sheet path. The registration roller 3 and the pinch roller 4 correct skewed feeding of the sheet S and transport the sheet S toward the transfer unit 30. The transfer belt 31, which is rotated by the drive roller 32, transports the sheet S in the transport direction F while electrostatically adhering it. The image-forming units 10K, 10Y, 10M, and 10C respectively form a black toner image, a yellow toner image, a magenta toner image, and a cyan toner image. The transfer rollers 34K, 34Y, 34M, and 34C transfer these toner images to the sheet S on the transfer belt 31 in series. The sheet S with the transferred toner images thereon is transported to the fixing unit 40 by the transfer belt 31. In the fixing unit 40, the heat roller 41 and the backup roller 42 fix the transferred toner images onto the sheet S with heat and pressure. The transport rollers 6 deliver the sheet S with the fixed toner images thereon to the stacker 7.

Next, an internal operation of the image-forming unit 10K in the printing operation will be described with reference to FIGS. 2 and 5. When the printing operation is initiated, the electric power supply 12*p* applies −1,000 volts to the charging roller 12. The charging roller 12 uniformly charges a surface of the photosensitive drum 11 at −500 Volts. The exposure head 5K (See, e.g., FIG. 1) exposes the charged surface of the photosensitive drum 11 to light. Whereas an unexposed surface of the photosensitive drum 11 has a potential of −500 Volts, the exposed surface thereof has a ground potential (0 Volts). That is to say, an electrostatic latent image is formed on the photosensitive drum 11.

The developing roller 13 develops the electrostatic latent image on the photosensitive drum 11 with toner 24. The toner 24 on the developing roller 13 is being negatively charged, and the electric power supply 13*p* applies a direct voltage of −200 Volts to the developing roller 13. This allows the toner 24 to move from the developing roller 13 to the exposed surface of the photosensitive drum 11, thereby forming a toner image on the photosensitive drum 11.

The transfer roller 34K transfers the toner image to the sheet S on the transfer belt 31 (See, e.g., FIG. 1) by a transfer voltage from the electric power supply 34*p*. The cleaning blade 20 scrapes toner that remains on the photosensitive drum 11 off the photosensitive drum 11 after the toner image has been transferred to the sheet S. The spiral conveyer 21 conveys the scraped off toner, i.e., waste toner, to the waste toner chamber, not shown.

Figure 6:
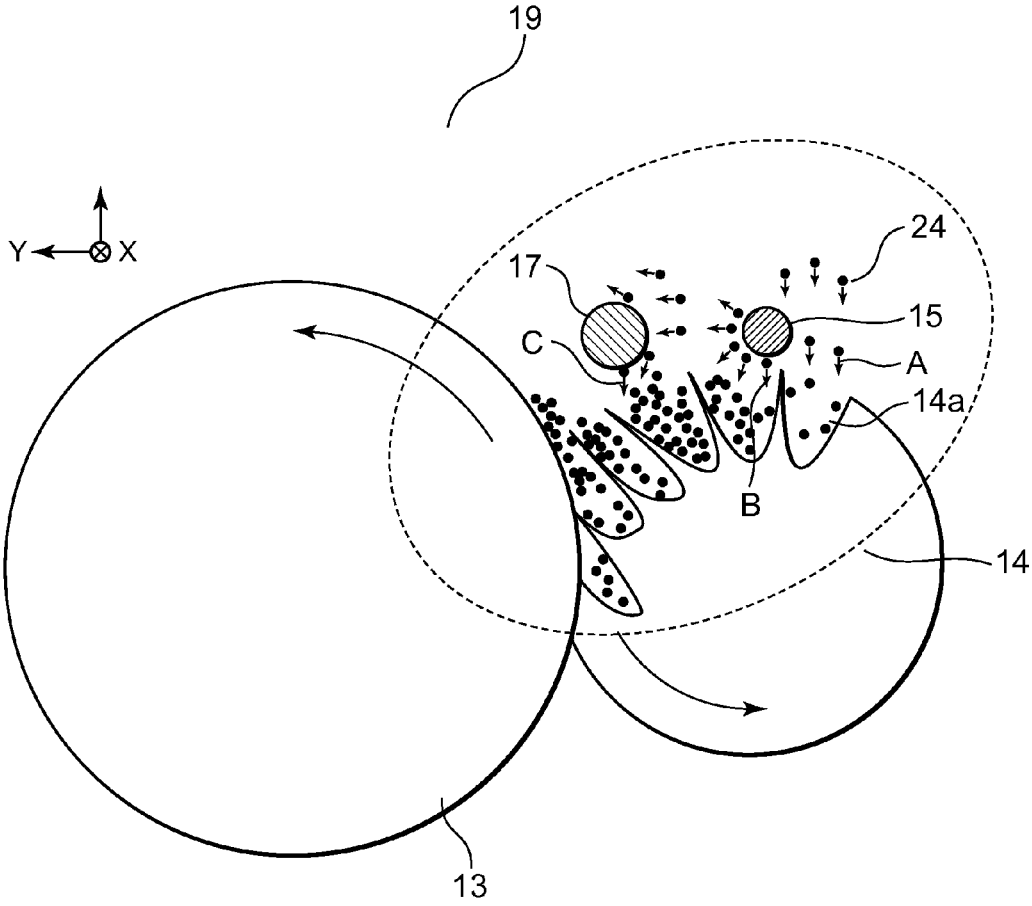
FIG. 6 is a cross-sectional view of a developing roller, a toner supply roller, the agitator, and the compression member of the first embodiment.

Next, an operation for supplying the toner 24 from the toner supply roller 14 to the developing roller 13 will be described. FIG. 6 is a cross-sectional view of the developing roller 13, the toner supply roller 14, the agitator 15, and the compression member 17 and will be referenced to explain this operation. In FIG. 6, a part of the toner supply roller 14 enclosed by a dashed line is magnified for convenience of explanation.

Referring to FIG. 6, the toner 24 in the toner storage portion 19 shifts downwardly under the force of gravity. Toner 24 that is supplied into a cell 14*a* of the toner supply roller 14 is held therein (indicated by a path A). Toner 24 that is within the radius of rotation R of the agitator 15 (See, e.g., FIG. 3) is moved in an outward radial direction of the agitator 15, and is held in the cell 14*a* (indicated by a path B). Toner 24 that is moved toward the compression member 17 by the agitator 15 and that comes into contact with a lower portion of the compression member 17 moves toward the toner supply roller 14 after its direction of travel is changed by the compression member 17 (indicated by a path C). The toner 24 is compressed between the toner supply roller 14 and the compression member 17, thereby increasing its density. The compressed toner 24 moves into the cell 14*a* and is held therein.

The toner supply roller 14 rotates in the same direction as the developing roller 13 while in contact with the developing roller 13. At this time, the cell 14*a* is pressed toward the developing roller 13 while moving. Therefore, the cell 14*a* is deformed and thereby discharges the toner 24 therein to the developing roller 13.

As described above, in the first embodiment, the toner 24 in the toner storage portion 19 is supplied to the cell 14*a* of the toner supply roller 14 through the three paths. That is to say, the toner 24 is supplied to the cell 14*a* through the path A along which the toner 24 moves toward the toner supply roller 14 under the force of gravity, the path B along which the toner 24 is moved toward the toner supply roller 14 by the agitator 15, and the path C along with the toner 24 moves toward the toner supply roller 14 after its direction of travel has been changed by the compression member 17. Therefore, the toner supply roller 14 can hold more toner 24 in the cell 14*a*, thereby providing a steady supply of the toner 24 to the developing roller 13.

Next, advantages of the first embodiment will be described by comparison with a first comparative example and a second comparative example, based on an evaluation test of performance for supplying the toner 24 from the toner supply roller 14 to the developing roller 13.

Figure 7:
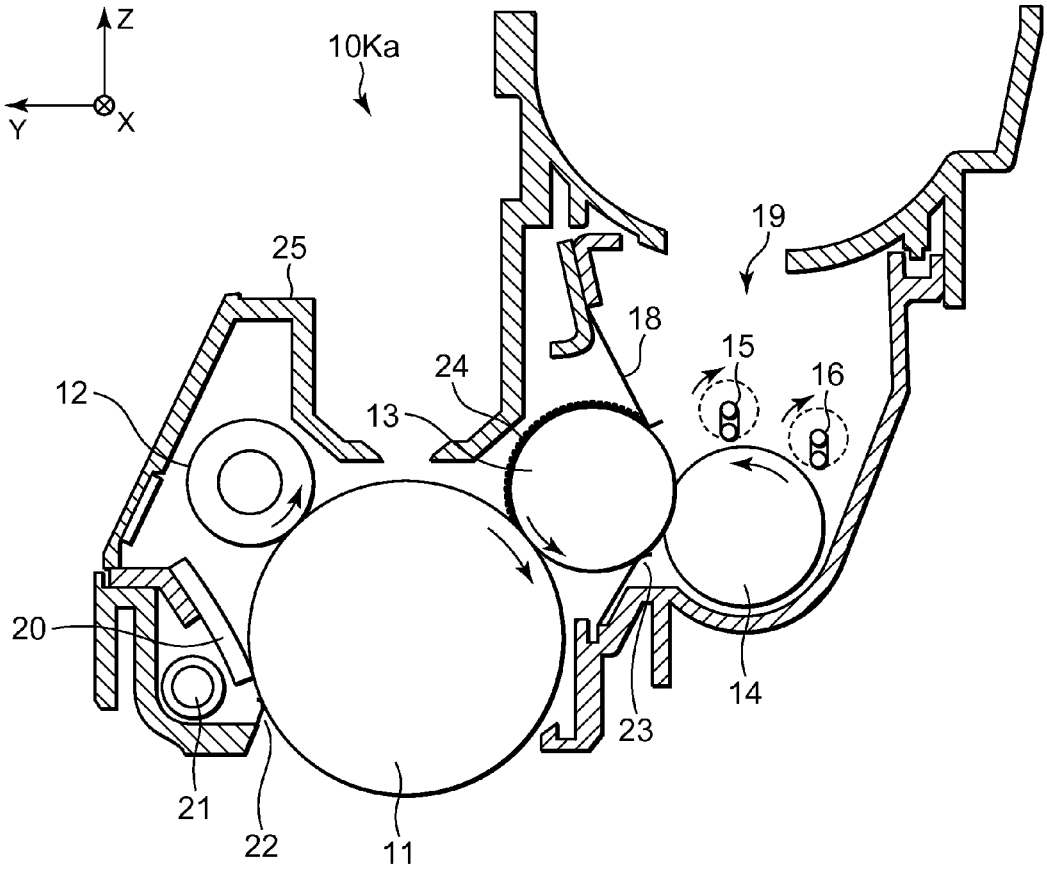
FIG. 7 is a schematic view of an image-forming unit of a first comparative example.
Figure 8:
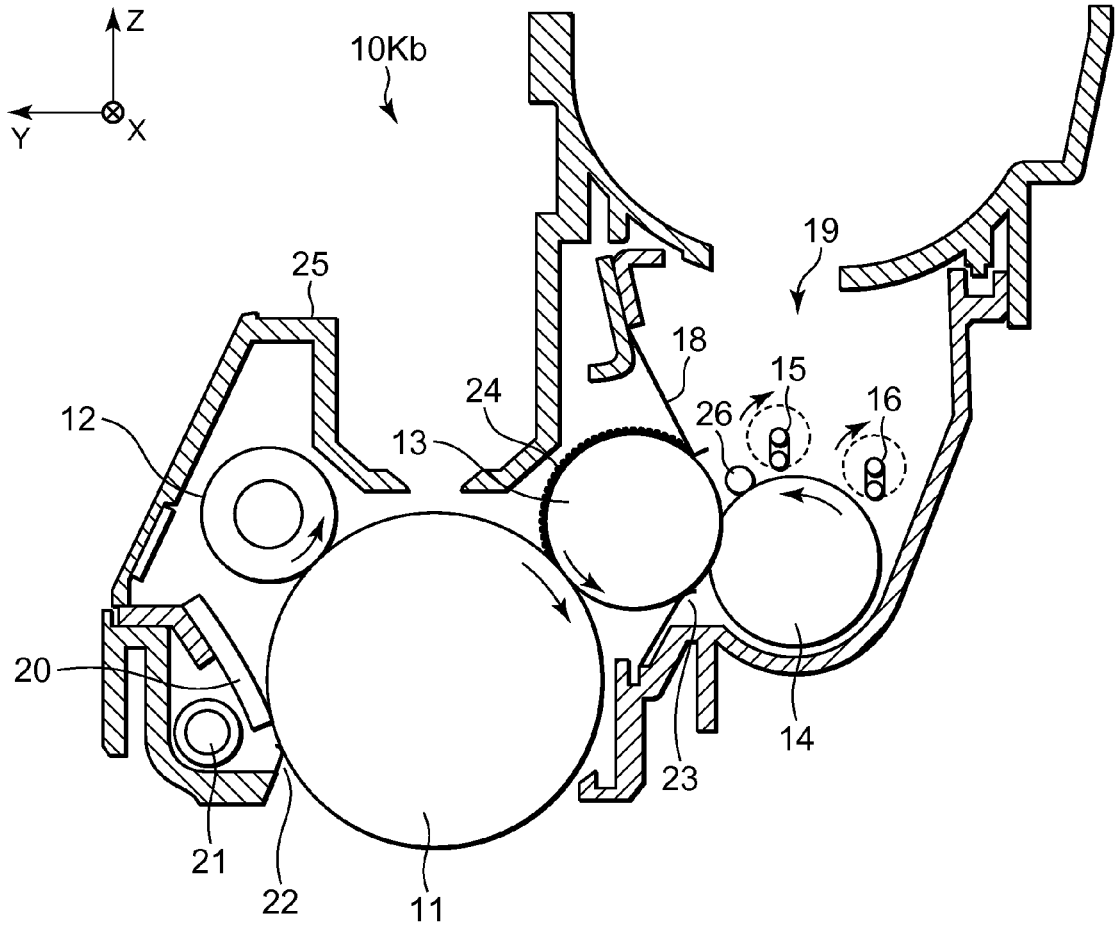
FIG. 8 is a schematic view of an image-forming unit of a second comparative example.

As described above, in the image-forming unit 10K of the first embodiment, the compression member 17 is a round bar that has a major diameter of 2 mm, and the distance between the toner supply roller 14 and the compression member 17 is 1 mm. As shown in FIG. 7, an image-forming unit 10Ka of the first comparative example has the same structure as the image-forming unit 10K, except without the compression member 17. As shown in FIG. 8, an image-forming unit 10Kb of the second comparative example has a compression member 26 in place of the compression member 17 of the image-forming unit 10K of the first embodiment. The compression member 26 is a round bar that is made of stainless steel and has a major diameter of 3 mm, and is in contact with the toner supply roller 14. The other structure of the image-forming unit 10Kb is similar to that of image-forming unit 10K.

In this test, no-image printing was continuously performed on 7,500 sheets with a color printer (C710: OKI Data Corp.) for each of the image-forming units 10K, 10Ka, and 10Kb. Each time a total of 0, 2,000, 4,000, 6,500, and 7,500 no-image prints were obtained, a solid image pattern (print density 100%) was printed on a sheet, and the presence or absence of image defects on the solid image pattern was evaluated. The solid image pattern was printed in color with four image-forming units (e.g., the image-forming units 10K, 10Y, 10M, and 10C). In this test, the no-image printing was performed so as to accelerate the deterioration of the toner 24 by repeatedly applying pressure to the toner 24 between the developing roller 13 and the toner supply roller 14 without consuming the toner 24.

FIG. 9 is a table showing results of the evaluation test. In FIG. 9, a symbol "○" indicates that no image defect occurred on the solid image pattern. In addition, symbols "Δ" and "x" respectively indicate that image blurring, i.e., image defects, partially and wholly occurred on the solid image pattern.

As shown in FIG. 9, in the image-forming unit 10K of the first embodiment (See, e.g., FIG. 2), no image defect occurred on the solid image pattern even after a total of 7,500 no-image prints were obtained.

In the image-forming unit 10Ka of the first comparative example (See, e.g., FIG. 7), image blurring partially occurred on the solid image pattern after a total of 4,000 no-image prints were obtained. Further, image blurring wholly occurred on the solid image pattern after a total of 7,500 no-image prints were obtained.

In the image-forming unit 10Ka, the toner 24 in the toner storage portion 19 is supplied to the cell 14*a* of the toner supply roller 14 through only two paths, i.e., the paths A and B in FIG. 6, because of the lack of the compression member 17. Therefore, supply of the toner 24 to the cell 14*a* gradually decreases due to the deterioration with time of elements in the image-forming unit 10Ka, such as the deterioration of the toner 24 or the abrasion of the cell 14*a*, resulting in the occurrence of the image blurring. Specifically, when the toner 24 is repeatedly pressed between the developing roller 13 and the toner supply roller 14, additives come off or are pressed into a mother particle of the toner 24, resulting in lowering flowability of the toner 24. In addition, because the toner supply roller 14 rotates while in contact with the developing roller 13, an opening of the cell 14*a* gradually gets smaller. This causes a decrease in supply of the toner 24 to the cell 14*a*, resulting in the occurrence of the image blurring on the solid image pattern.

In the image-forming unit 10Kb of the second comparative example (See, e.g., FIG. 8), image blurring partially occurred on the solid image pattern after a total of 2,000 no-image prints were obtained. Further, image blurring wholly occurred on the solid image pattern after a total of 7,500 no-image prints were obtained.

In the image-forming unit 10Kb, because the compression member 26 is in contact with the toner supply roller 14, the toner 24 is scraped off the cell 14*a* by the compression member 26 before being supplied to the developing roller 13. This causes a decrease in the amount of the toner 24 in the cell 14*a*, resulting in the occurrence of the image blurring on the solid image pattern.

As described above, in the first embodiment, the image-forming unit 10K has the compression member 17 between the developing roller 13 and the agitator 15. The compression member 17 directs toner 24 sent forth by the agitator 15 to the toner supply roller 14, and compresses the toner 24 between the toner supply roller 14 and the compression member 17. Therefore, the image-forming unit 10K is capable of increasing the amount of the toner 24 in the cell 14*a* of the toner supply roller 14, thereby providing a steady supply of the toner 24 from the toner supply roller 14 to the developing roller 13. Thus, the image-forming unit 10K is capable of preventing the occurrence of image defects such as image blurring.

In addition, in the image-forming unit 10K, because the compression member 17 is out of contact with the toner supply roller 14, the toner 24 is not scraped off the cell 14*a* by the compression member 17.

Moreover, in the image-forming unit 10K, the compression member 17 lies downstream of the agitator 15 in the rotational direction of the toner supply roller 14. Therefore, the image-forming unit 10K is capable of increasing the amount of the toner 24 in the cell 14*a*, in the vicinity of a contact region of the toner supply roller 14 that is in contact with the developing roller 13. Thus, the image-forming unit 10K is capable of supplying the toner 24 more effectively from the toner supply roller 14 to the developing roller 13.

Furthermore, in the image-forming unit 10K, because the agitators 15 and 16 are arranged side-by-side in the rotational direction of the toner supply roller 14, the amount of the toner 24 in the cell 14*a* further increases.

Second Embodiment

Figure 10:
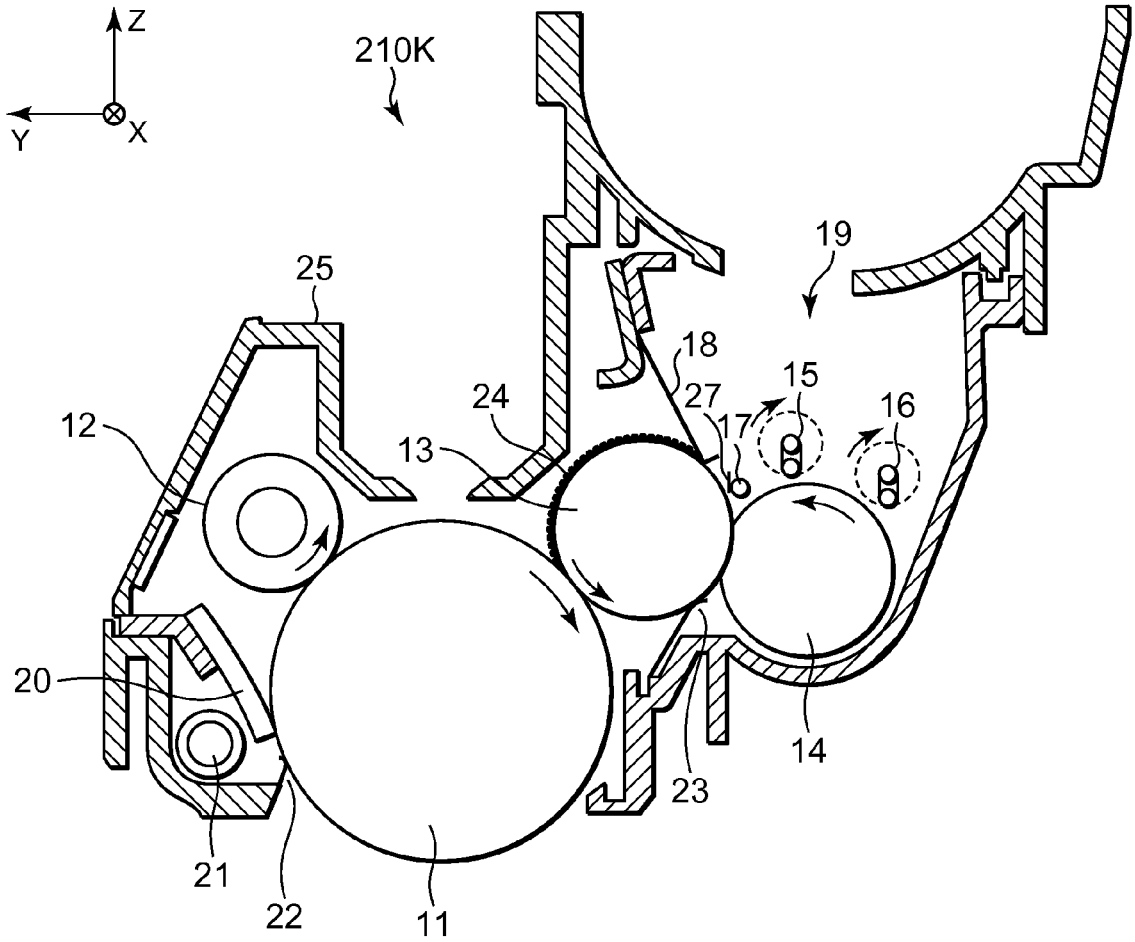
FIG. 10 is a schematic view of an image-forming unit of a second embodiment.

FIG. 10 is a schematic view of an image-forming unit 210K of a second embodiment, which includes a barrier plate 27 that directs the toner 24 from end portions to a central portion in the longitudinal direction of the compression member 17, in addition to the compression member 17. The other structural elements of the image-forming unit 210K are similar to those of the image-forming unit 10K of the first embodiment. Therefore, elements similar to those in the first embodiment have been assigned the same numerals, and their description is partially omitted.

Figure 11:
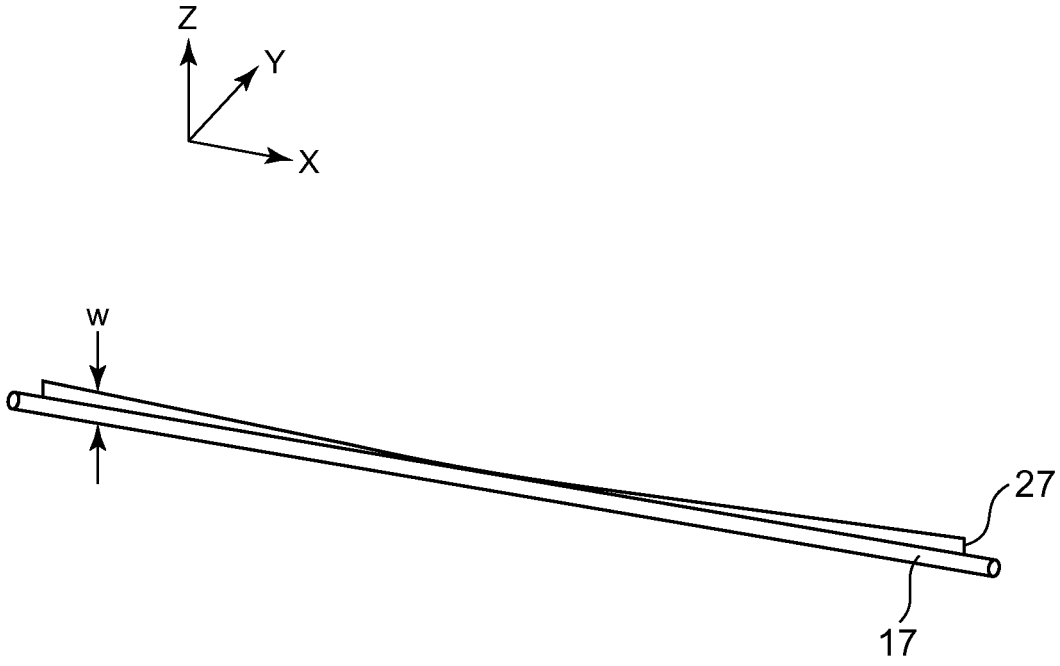
FIG. 11 is a perspective view of the compression member and a barrier plate of the second embodiment.

FIG. 11 is a perspective view of the compression member 17 and the barrier plate 27. As shown in FIG. 11, the width W of the barrier plate 27, which serves as a barrier member, gradually broadens from a central portion toward end portions in the longitudinal direction thereof, i.e., in the X-axis direction. In the second embodiment, the barrier plate 27 has a width W of 0 mm at its central portion. That is to say, there is no barrier plate 27 in the vicinity of the central portion of the compression member 17. Meanwhile, the barrier plate 27 has a width W of 3 mm at each of its end portions.

Figure 12A:
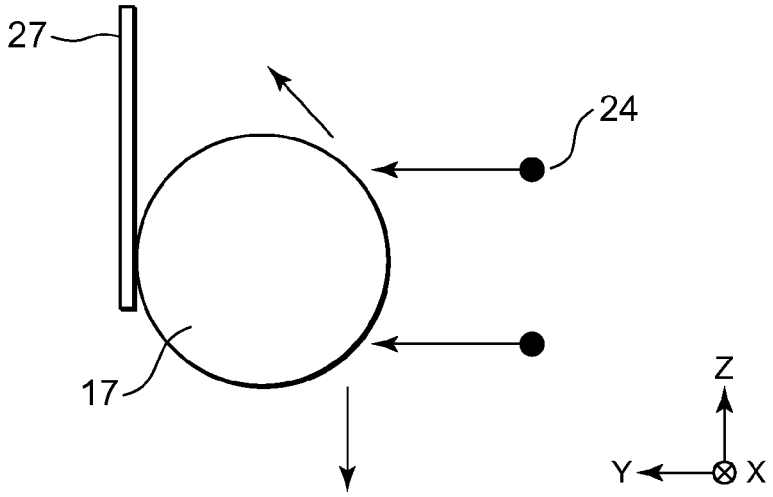
FIG. 12A is a side view showing the movement of toner in the vicinity of the compression member and the barrier plate of the second embodiment.
Figure 12B:
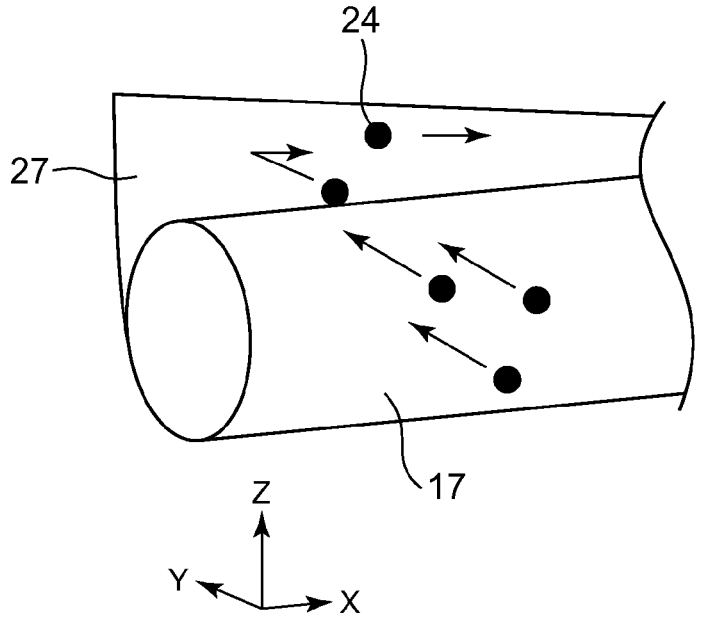
FIG. 12B is a perspective view showing the movement of the toner in the vicinity of the compression member and the barrier plate of the second embodiment.

FIGS. 12A and 12B are respectively a side view and a perspective view, showing the movement of the toner 24 in the vicinity of the compression member 17 and the barrier plate 27. As shown in FIG. 12A, toner 24 that is moved toward the compression member 17 by the agitator 15 and that comes into contact with a lower portion of the compression member 17, moves toward the toner supply roller 14 after its direction of travel is changed by the compression member 17.

On the other hand, toner 24 that comes into contact with an upper portion of the compression member 17 goes over the compression member 17, and moves toward the developing roller 13, i.e., in the Y-axis direction. As shown in FIG. 12B, the toner 24 that moves toward the developing roller 13 comes into contact with the end portions of the barrier plate 27. As a result, the movement of the toner 24 in the Y-axis direction is hampered. Inside walls of the image-forming unit 210K that oppose both ends of the compression member 17 have sealing members, not shown, so as to prevent the toner 24 from leaking out of the image-forming unit 210K. Therefore, the toner 24 that comes into contact with the barrier plate 27 is directed to the central portion of the compression member 17 along the barrier plate 27 extending in the X-axis direction. Meanwhile, because the width W of the barrier plate 27 is small in the vicinity of the central portion of the compression member 17, the toner 24 that goes over the compression member 17 moves toward the developing roller 13 with little resistance by the barrier plate 27.

In general, because an image-forming unit consumes less toner in its internal end regions than in its internal central region in the X-axis direction, deteriorated toner is liable to accumulate in the end regions of the image-forming unit. The deteriorated toner is poorly movable due to its decreased flowability. Therefore, the amount of toner supplied to the cell 14*a* of the toner supply roller 14 decreases in the end regions of the image-forming unit, resulting in the occurrence of image defects such as image blurring at end portions of the sheet S in the X-axis direction.

In the image-forming unit 210K of the second embodiment, however, the barrier plate 27 directs the deteriorated toner from the end regions to the central region in the X-axis direction. Therefore, the deteriorated toner is less likely to accumulate in the end regions of the image-forming unit 210K, thereby preventing the occurrence of image defects at end portions of the sheet S in the X-axis direction.

As described above, in the second embodiment, the image-forming unit 210K has the barrier plate 27 that directs the toner 24 from the end regions to the central region in the longitudinal direction of the compression member 17, in addition to the compression member 17. Therefore, the image-forming unit 210K is capable of preventing deteriorated toner from accumulating in end regions of the image-forming unit 210K in the X-axis direction, thereby preventing the occurrence of image defects at end portions of the sheet S.

While each of the embodiments has been described with respect to an electrophotographic color printer, the disclosed systems may also be applicable to a facsimile machine, a copier, or a multifunction peripheral (MFP).

The developing device and the image forming apparatus being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A developing device comprising:

a rotatable developer bearing body configured to bear a developer;

a first developer supply member that contacts the developer bearing body at a first contact portion to supply the developer to the developer bearing body and that is rotatable in the same direction as the developer bearing body;

a layer thickness adjusting member that contacts the developer bearing body at a second contact portion to adjust a thickness of a layer of the developer on the developer bearing body;

a second developer supply member configured to move the developer in the vicinity of the first developer supply member to the first developer supply member; and a compression member that opposes, and that is out of contact with, the first developer supply member, and that is configured to direct the developer moved by the second developer supply member to the first developer supply member and compress the developer onto the first developer supply member, wherein the compression member lies downstream of the first contact portion, and upstream of the second contact portion, in the rotational direction of the developer bearing body.

2. The developing device according to claim 1, wherein the compression member is disposed between the developer bearing body and the second developer supply member.

3. The developing device according to claim 1, wherein the compression member lies downstream of the second developer supply member in the rotational direction of the first developer supply member.

4. The developing device according to claim 1, wherein the compression member is a bar.

5. The developing device according to claim 1, wherein the second developer supply member is a crank bar that agitates the developer.

6. The developing device according to claim 1, further comprising a barrier member.

7. The developing device according to claim 6, wherein a width of the barrier member gradually increases from a central portion toward end portions in a longitudinal direction of the barrier member.

8. The developing device according to claim 1, further comprising a plurality of second developer supply members.

9. The developing device according to claim 8, wherein the second developer supply members are arranged side-by-side in the rotational direction of the first developer supply member.

10. The developing device according to claim 1, further comprising a plurality of compression members.

11. An image forming apparatus comprising:

a developing unit configured to develop an electrostatic latent image on an image bearing body with a developer to form a developed image, including a rotatable developer bearing body configured to bear the developer, a first developer supply member that contacts the developer bearing body at a first contact portion to supply the developer to the developer bearing body and that is rotatable in the same direction as the developer bearing body, a layer thickness adjusting member that contacts the developer bearing body at a second contact portion to adjust a thickness of a layer of the developer on the developer bearing body, a second developer supply member configured to move the developer in the vicinity of the first developer supply member to the first developer supply member, and a compression member that opposes and is out of contact with the first developer supply member, and configured to direct the developer moved by the second developer supply member to the first developer supply member and compress the developer onto the first developer supply member, wherein the compression member lies downstream of the first contact portion, and upstream of the second contact portion, in the rotational direction of the developer bearing body;

a transfer unit configured to transfer the developed image to a medium; and a fixing unit configured to fix the developed image onto the medium.

12. The image forming apparatus according to claim 11, wherein the compression member is disposed between the developer bearing body and the second developer supply member.

13. The image forming apparatus according to claim 11, wherein the compression member lies downstream of the second developer supply member in the rotational direction of the first developer supply member.

14. The image forming apparatus according to claim 11, wherein the compression member is a bar.

15. The image forming apparatus according to claim 11, wherein the second developer supply member is a crank bar that agitates the developer.

16. The image forming apparatus according to claim 11, further comprising a barrier member.

17. The image forming apparatus according to claim 16, wherein a width of the barrier member gradually increases from a central portion toward end portions in a longitudinal direction of the barrier member.

18. The image forming apparatus according to claim 11, further comprising a plurality of second developer supply members.

19. The image forming apparatus according to claim 18, wherein the second developer supply members are arranged side-by-side in the rotational direction of the first developer supply member.

20. The developing device according to claim 11, further comprising a plurality of compression members.

* * * * *